US005242774A

United States Patent [19]

Odell et al.

[11] Patent Number: 5,242,774

[45] Date of Patent: Sep. 7, 1993

[54] PHOTOCONDUCTIVE IMAGING MEMBERS WITH FLUORINATED POLYCARBONATES

[75] Inventors: Peter G. Odell; Dasarao K. Murti, both of Ontario, Canada

[73] Assignee: Xerox Corporation, Stamford, Conn.

[21] Appl. No.: 858,470

[22] Filed: Mar. 27, 1992

[51] Int. Cl.[5] ..... G03G 5/047

[52] U.S. Cl. ..... 430/59; 430/58

[58] Field of Search ..... 430/58, 59

[56] References Cited

U.S. PATENT DOCUMENTS

| | | | |
|---|---|---|---|
| 3,121,006 | 2/1964 | Middleton et al. . | |
| 4,007,043 | 2/1977 | Stolka et al. . | |
| 4,030,921 | 6/1977 | Akira et al. . | |
| 4,063,947 | 12/1977 | Pochan et al. . | |
| 4,232,101 | 11/1980 | Fukuda et al. | 430/56 |
| 4,265,990 | 5/1981 | Stolka et al. | 430/59 |
| 4,663,259 | 5/1987 | Fujimura et al. | 430/58 |
| 4,677,044 | 6/1987 | Yamazaki et al. | 430/58 |
| 4,724,195 | 2/1988 | Muller et al. | 430/192 |
| 4,734,347 | 3/1988 | Endo et al. | 430/66 |
| 4,772,526 | 9/1988 | Kan et al. | 430/58 |
| 4,784,928 | 11/1988 | Kan et al. | 430/58 |
| 4,803,140 | 2/1989 | Hiro | 430/58 |
| 4,863,823 | 9/1989 | Hiro et al. | 430/58 |
| 4,869,982 | 9/1989 | Murphy | 430/48 |

FOREIGN PATENT DOCUMENTS

| | | | |
|---|---|---|---|
| 215959 | 9/1987 | Japan | 430/58 |
| 319750 | 12/1989 | Japan | 430/59 |
| 189550 | 7/1990 | Japan | 430/59 |

*Primary Examiner*—Roland Martin

*Attorney, Agent, or Firm*—E. O. Palazzo

[57] ABSTRACT

An abrasion resistant photoconductive imaging member comprised of a supporting substrate, a photogenerating layer and a charge transport layer comprised of charge transport components dispersed in a fluorinated polycarbonate.

23 Claims, 1 Drawing Sheet

PHOTOCONDUCTIVE IMAGING MEMBERS WITH FLUORINATED POLYCARBONATES

BACKGROUND OF THE INVENTION

This invention is generally directed to imaging members and to processes thereof. More specifically, the present invention is directed to layered photoconductive imaging members comprised of a supporting substrate, a photogenerating layer, and thereover a charge transport layer comprised of charge transport molecules dispersed in a fluorinated polycarbonate resin binder. Advantages associated with the imaging members of the present invention include wear resistant charge transport layers, life extension of the imaging members by, for example, 50,000 imaging cycles in xerographic imaging devices, such as the Xerox Corporation 5090, resistance to abrasion during cleaning, especially with wiper blades, and by contact with carrier particles, efficient and effective cleaning, and the like. The photoresponsive imaging members of the present invention can also, for example, contain situated between the photogenerating layer and a hole transporting layer, or situated between the photogenerating layer and a supporting substrate with a charge transport layer in contact with the photogenerating layer, a photoconductive composition comprised of, for example, bisazo photogenerating pigments.

Layered imaging members are known. These imaging members can be comprised of photogenerating layers, and in contact therewith charge transport layers comprised of aryldiamines, reference U.S. Pat. No. 4,265,990, the disclosure of which is totally incorporated herein by reference. Layered imaging members with charge transport arylamines dispersed in resin binders, like polycarbonates, such as MAKROLON ®, are known. Examples of highly insulating and transparent resinous components or inactive binder resinous material for the transport layer include materials such as those described in U.S. Pat. No. 3,121,006, the disclosure of which is totally incorporated herein by reference. Specific examples of known organic resinous materials include polycarbonates, acrylate polymers, vinyl polymers, cellulose polymers, polyesters, polysiloxanes, polyamides, polyurethanes and epoxies as well as block, random or alternating copolymers thereof. Preferred electrically inactive binder materials are polycarbonate resins having a molecular weight of from about 20,000 to about 100,000 with a molecular weight in the range of from about 50,000 to about 100,000 being particularly preferred. The materials usually preferred as electrically inactive resinous are poly(4,4'-dipropylidene-diphenylene carbonate) with a weight average molecular weight of from about 35,000 to about 40,000 available as LEXAN TM 145 from General Electric Company; poly(4,4'-isopropylidene-diphenylene carbonate) with a weight average molecular weight of from about 40,000 to about 45,000 available as LEXAN TM 141 from General Electric Company; a polycarbonate resin having a weight average molecular weight of from about 50,000 to about 100,000 available as MAKROLON ® from Farbenfabricken Bayer AG; and a polycarbonate having a weight average molecular weight of from about 20,000 to 50,000 available as MERLON ® from Mobay Chemical Company. Generally, the resinous binder contains from about 10 to about 75 percent by weight of the active material corresponding to the foregoing formula, and preferably from about 35 percent to about 50 percent of this material. Examples of binder material for the photogenerating layer include poly(vinyl acetals), polycarbonates as mentioned herein, polyesters, polyvinyl carbazole, and the like. Typical effective amounts of binder can be selected including, for example, from about 5 to about 95, and preferably from about 10 to about 70 weight percent. These imaging members while suitable for their intended purposes can possess a number of disadvantages, such as being substantially nonresistant to cleaning, and subject to abrasion after about 25,000 imaging cycles, thereby causing undesirable copies with reduced quality. These imaging members can also be difficult to clean or require complex and expensive cleaning systems to achieve adequate cleaning. These and other disadvantages are avoided, or minimized with the imaging members of the present invention.

Imaging members with certain bisazo pigments are known, reference for example U.S. Pat. No. 3,898,084, which discloses, for example, the azo pigment Chlorodiane Blue in a photoconductive imaging member. Further, there are disclosed in the prior art layered photoresponsive devices, including those comprised of separate generating layers, and transport layers as described in U.S. Pat. No. 4,265,990, the disclosure of which is totally incorporated herein by reference; and overcoated photoresponsive materials containing a hole injecting layer overcoated with a hole transport layer, followed by an overcoating of a photogenerating layer; and a top coating of an insulating organic resin, reference U.S. Pat. No. 4,251,612. Examples of photogenerating layers disclosed in these patents include trigonal selenium and phthalocyanines, while examples of transport layers include certain diamines as mentioned therein.

U.S. Pat. No. 4,713,307, the disclosure of which is totally incorporated herein by reference, discloses photoconductive imaging members containing a supporting substrate, certain azo pigments as photogenerating materials, and a hole transport layer that preferably contains an aryl diamine compound dispersed in an inactive resinous binder, such as a polycarbonate.

U.S. Pat. No. 4,797,337, the disclosure of which is totally incorporated herein by reference, discloses a photoconductive imaging member comprising a supporting substrate, a hole transport layer, and a photogenerating layer comprising specific disazo compounds.

In a patentability search report the following U.S. patents were recited: No. 4,772,526, which discloses a reusable electrophotographic imaging element having a photoconductive surface layer in which the binder resin comprises a block copolyester or copolycarbonate having a fluorinated polyether block, see the Abstract for example; No. 4,030,921, which discloses an electrophotographic photosensitive material including a conductive backing and a photosensitive layer being formed of a photoconductive material, a resin binder, and a fluorine containing resin which can be a polymer or copolymer having a fluorine contained monomer as its structural units and is preferably soluble in a solvent, see the Abstract for example; Pat. No. 4,663,259, which discloses an electrophotographic sensitive member comprising a conductive substrate, a charge transport layer and a charge generation layer wherein said charge generation layer is superimposed on said charge transport layer and said charge generation layer contains particles of certain fluorine containing resins, see the Abstract for example; Nos. 4,007,043; 4,063,947; 4,784,928; 4,803,140; 4,863,823; 4,869,982; and as background of collateral interest 4,232,101; 4,677,044; 4,724,195 and 4,734,347.

Additional references illustrating layered organic electrophotographic photoconductor elements with azo, bisazo, and related compounds, and charge transport layers dispersed in certain resin binders, such as polycarbonates, include U.S. Pat. No. 4,390,611, U.S. Pat. No. 4,551,404, U.S. Pat. No. 4,596,754, Japanese Patent 60-64354, U.S. Pat. No. 4,400,455, U.S. Pat. No. 4,390,608, U.S. Pat. No. 4,327,168, U.S. Pat. No. 4,299,896, U.S. Pat. No. 4,314,015, U.S. Pat. No. 4,486,522, U.S. Pat. No. 4,486,519, U.S. Pat. No. 4,555,667, U.S. Pat. No. 4,440,845, U.S. Pat. No. 4,486,800, U.S. Pat. No. 4,309,611, U.S. Pat. No. 4,418,133, U.S. Pat. No. 4,293,628, U.S. Pat. No. 4,427,753, U.S. Pat. No. 4,495,264, U.S. Pat. No. 4,359,513, U.S. Pat. No. 3,898,084, U.S. Pat. No. 4,830,944 and U.S. Pat. No. 4,820,602.

U.S. Pat. No. 4,755,443 discloses a photoreceptor for electrophotography which comprises a charge carrier generating material and charge transport material wherein one charge generating material is a metal phthalocyanine or a metal-free phthalocyanine. The layer containing the generator material also contains an organic amine. Other carrier generating substances can be used in combination with the phthalocyanine generator material, including azo pigments, anthraquinone dyes, perylene dyes, polycyclic quinone dyes, and methine stearate pigments.

U.S. Pat. No. 4,424,266 discloses an electrophotographic photosensitive element having a conductive support and a photosensitive layer comprising a carrier generating phase layer containing a carrier generating material selected from the group consisting of perylene dyes, polycyclic quinones, and azo dyes, and a carrier transporting phase layer containing a hydrazone carrier transporting material.

U.S. Pat. No. 4,808,506, the disclosure of which is totally incorporated herein by reference, discloses a layered photoresponsive imaging member which comprises a supporting substrate, an imidazole perinone comprising components with a mixture of cis and trans isomers of a specific formula, including trans indanthrene Brilliant Orange, cis indanthrene Bordeauxs Red, bis-(4,5-dimethyl)benzimidazole perinone and bis-2,3-naphthimidazole perinone, and an aryl amine hole transport layer comprised of aryldiamines dispersed in a number of resin binders, such as polycarbonates.

SUMMARY OF THE INVENTION

It is an object of the present invention to provide imaging members with many of the advantages illustrated herein.

Another object of the present invention is to provide charge transport layers comprised of charge transporting molecules and fluorinated polycarbonates, which members can be sensitive to wavelengths of from about 400 to about 800 and preferably from about 400 to about 680 nanometers.

In another object of the present invention there are provided abrasion resistant layered imaging members comprised of a photogenerating layer and thereover as a top layer a charge transport layer wherein the charge transport molecules are dispersed in a fluorinated polycarbonate, or a mixture of fluorinated polycarbonates.

Another object of the present invention resides in the provision of photoresponsive imaging members which can possess excellent dark decay properties, high charge acceptance values, and electrical stability.

Further, in another object of the present invention there are provided photoconductive imaging members that can be simultaneously responsive to visible light and radiation from LED devices, depending primarily on the photogenerating pigment selected.

Furthermore, in another object of the present invention there are provided layered imaging members wherein the top charge transport layer retains its thickness subsequent to cleaning, and collisions with carrier particles for 100,000 imaging cycles.

Additionally, another object of the present invention resides in the provision of imaging and printing methods with the photoconductive imaging members illustrated herein.

Moreover, in another object of the present invention there are provided layered imaging members with wear resistant characteristics and wherein there can be achieved in embodiments a reduction in the surface free energy thereof.

These and other objects of the present invention in embodiments thereof can be accomplished by the provision of layered photoconductive imaging members. More specifically, the present invention is directed to photoconductive imaging members with charge transport layers comprised of known charge transporting molecules, or components, such as aryldiamines, dispersed in a fluorinated polycarbonate resin binder.

In one embodiment, the present invention is directed to an abrasion resistant photoconductive imaging member comprised of a supporting substrate, a photogenerating layer and a charge transport layer comprised of charge transport components dispersed in a fluorinated polycarbonate.

The imaging member of the present invention in embodiments can be comprised of a supporting substrate, such as aluminum, MYLAR®, titanized MYLAR® and the like, thereover a photogenerating layer comprised of known photogenerating pigments such as trigonal selenium, amorphous selenium, metal phthalocyanines like copper phthalocyanine, metal free phthalocyanines like x-metal free, vanadyl phthalocyanine, squaraines, bisazos, azos, titanyl phthalocyanines especially Type IV, and the like, optionally dispersed in a resin binder, and thereover in contact with the photogenerating layer a charge transport layer comprised of charge transport, especially hole transport components, like known aryldiamines dispersed in a fluorinated polycarbonate resin binder.

An important aspect of the present invention resides in the selection of a fluorinated polycarbonate as the resin binder for the charge transport components. Illustrative resin binder examples of fluorinated polycarbonates include poly(4,4'-hexafluoroisopropylidene bisphenol-co-4,4'-(1,4-phenylenebisisopropylidene) bisphenol) carbonate; poly(4,4'-hexafluoropropylidene bisphenol-co-4,4'-(1,4-phenylenebispropylidene) bisphenol) carbonate; poly(4,4'-hexafluoroalkylidene bisphenol-co-4,4'-(1,4-phenylenebisalkylidene) bisphenol) carbonate wherein alkyl is methyl, ethyl, butyl, pentyl, hexyl, octyl, nonyl, and the like, and generally alkyl contains from 1 to about 25, and preferably from 1 to about 10 carbon atoms; poly(4,4'-hexafluoroisopropylidene bisphenol-co-4,4'-cyclohexylidene bisphenol) carbonate, poly(4,4'-hexafluoroisopropylidene bisphenol)

carbonate, poly(4,4'-hexafluoroisopropylidene bisphenol-co-4,4'-isopropylidene bisphenol) carbonate, poly(4,4'-hexafluoroisopropylidene bisphenol-co-4,4'-(1,3-phenylenebisisopropylidene) bisphenol) carbonate, poly(4,4'-hexafluoroisopropylidene bisphenol-co-4,4'-cyclohexylidene-2,2'-dimethyl bisphenol) carbonate, poly(4,4'-hexafluoroisopropylidene bisphenol-co-4,4'-isopropylidene-2,2'-dimethyl bisphenol) carbonate, poly(4,4'-hexafluoroisopropylidene bisphenol-co-(4,4'-(1,4-phenylenebisisopropylidene) bisphenol)-co-4,4'-biphenol) carbonate, poly(4,4'-hexafluoroisopropylidene bisphenol-co-4,4'-diphenylmethylidene bisphenol) carbonate, poly(4,4'-hexafluoroisopropylidene bisphenol-co-4,4'-cycloheptylidene bisphenol) carbonate, poly(4,4'-hexafluoroisopropylidene bisphenol-co-4-t-butylcyclohexylidene) bisphenol) carbonate, and poly(4,4'-hexafluoroisopropylidene bisphenol-co-(4,4'-(1,4-phenylenebisisopropylidene) bisphenol)-co-4,4'-dihydroxydiphenylether) carbonate.

In embodiments, the fluorinated polycarbonates selected can be represented by the following formula:

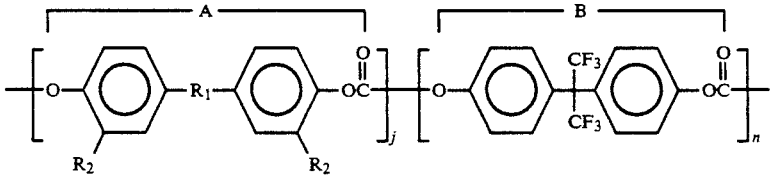

wherein A or the A portion represents the nonfluorinated portion of the polymer molecule derived from one or more, preferably one to two bisphenols, with specific examples of A including structures or segments derived from 4,4'-(1,4-phenylenebisisopropylidene) bisphenol, 4,4'-cycloheptylidene bisphenol, 4,4'-dihydroxydiphenylether, 4,4'-cycloheptylidene bisphenol, 4,4'-isopropylidene bisphenol, 4,4'-(1,3-phenylenebisisopropylidene) bisphenol, 4,4'-cyclohexylidene-2,2'-dimethyl bisphenol, 4,4'-cyclohexylidene bisphenol, 4,4'-isopropylidene-2,2'-dimethyl bisphenol, 4,4'-t-butylcyclohexylidene bisphenol, 4,4'-phenylcyclohexylidene bisphenol, 4,4'-(1-phenylethylidene) bisphenol, 4,4'-diphenylmethylidene bisphenol; and the like wherein j and n represent the number of repeating segments, m represents the number of repeating segments, $R_1$ and $R_2$ represent aliphatic, such as alkyl, and/or aromatic components, such as phenyl, naphthyl, substituted phenyl like benzyl, and the like. More specifically, j and n correspond to the degree of polymerization and are, for example, numbers ranging from about 4 to about 200; $R_1$ can be an alkylidene group with substitution usually at, but not necessarily restricted to, the same carbon atom, such as methylidene, 1,1-ethylidene, 1,2-ethylidene, 2,2-propylidene, butylidene, hexylidene, heptylidene, octylidene, cyclohexylidene, t-butylcyclohexylidene, phenylcyclohexylidene, cycloheptylidene and the like; alkyl or alkyl substituted with, for example, halogen such as fluoro, chloro and bromo, and aryl can contain substituents such as alkyl including methyl, ethyl, propyl, butyl, pentyl, hexyl, heptyl, octyl, nonyl, decyl, and the like; $R_1$ can also be 1,3-phenylenebisisopropylidene, 1,4-phenylenebisisopropylidene, a sulfonyl group, a carbonyl, oxygen, and the like; and the central substituent, $R_1$, need not be 1,4 or para to the oxygen but could be 1,3 or meta to the oxygen; $R_1$ can be replaced with a carbon bond between the two aryl or phenyl ring substituents; $R_2$ can be alkyl containing, for example, from 1 to about 25, and preferably 12 carbon atoms, such as methyl, ethyl, propyl, butyl, hexyl, octyl, nonyl, pentyl, and the like, hydrogen or halogen such as chlorine or bromine. Alkyl can be branched, for example, with alkyl groups or may contain aryl substituents. Alkyl contains in embodiments, for example, from 1 to about 25 carbon atoms, and aryl contains, for example, from 6 to about 24 carbon atoms, such as methyl, ethyl, and the like, phenyl, benzyl, naphthyl, cyclohexyl, t-butylcyclohexyl, phenylcyclohexyl, cycloheptyl and the like. Structures that may correspond to the "A" portion of the polymer molecule may be located in Hermann Schnell's *Chemistry and Physics of Polycarbonates*, Polymer Reviews V. 9, Interscience Publishers principally the structures found in Tables IV-1 pages 86 to 90 and also Tables IV-2, V-1, V-2, V-3, V-4, V-5, and V-6, the disclosure of which is totally incorporated herein by reference. Many of these segments may be prepared by the processes as illustrated in U.S. Pat. No. 4,766,255, the disclosure of which is totally incorporated herein by reference. Specific examples of A include structures or segments derived from 4,4'-(1,4-phenylenebisisopropylidene) bisphenol, 4,4'-cycloheptylidene bisphenol, 4,4'-dihydroxydiphenylether, 4,4'-cycloheptylidene bisphenol, 4,4'-isopropylidene bisphenol, 4,4'-(1,3-phenylenebisisopropylidene) bisphenol, 4,4'-cyclohexylidene-2,2'-dimethyl bisphenol, 4,4'-cyclohexylidene bisphenol, 4,4'-isopropylidene-2,2'-dimethyl bisphenol, 4,4'-t-butylcyclohexylidene bisphenol, 4,4'-phenylcyclohexylidene bisphenol, 4,4'-(1-phenylethylidene) bisphenol, 4,4'-diphenylmethylidene bisphenol.

The "B" portion of the polymer molecule can be derived from a fluorinated bisphenol. The fluorine may be substituted on either the aliphatic or aromatic substituents of the bisphenol structures that may be selected for the "A" portion. In embodiments, fluorine is incorporated into the polymer molecule by selecting 2,2 bis(4-hydroxyphenyl)hexafluoropropane, available from Hoechst Celanese Corporation, as the "B" bisphenol.

The polycarbonates of the present invention which are available from, for example, BASF can be prepared by known polyesterification methods. More specifically, the polycarbonates of the present invention can be prepared by the reaction of one or more, for example up to 5, preferably 3, and more preferably 2, in an embodiment bisphenols with a diaryl carbonate, especially bis(aryl)carbonates, reference U.S. Pat. No. 4,345,062, the disclosure of which is totally incorporated herein by reference, such as diphenyl carbonate; the bis(aryl)carbonate reactants are also commonly referred to as carbonic acid aromatic diesters and include those described by Formula III in U.S. Pat. No. 3,163,008, the disclosure of which is totally incorporated herein by reference, column 2, lines 23 to 72, and column 3, lines 1 to 42, with preferred bis(aryl)carbonates being diphenyl carbonate, dicresyl carbonate, bis(2-chlorophenyl)carbonate, the bis-phenyl-carbonates of hydroquinone, resorcinol and 4,4'-dihydroxydiphenyl, the bisphenyl carbonates of the bis(4-hydroxyaryl)alkanes, cycloalkanes, ethers, sulfides, sulfones, and the like; and a silanol terminated polysiloxane telomer, such as polydiphenyl siloxane in the presence of a catalyst, such as metal alkoxides, like titanium butoxide, titanium isopropoxide, zirconium isopropoxide; metal acetates, such as magnesium acetate, zinc acetate; tin compounds, such as dibutyltin oxide, di-n-butyltin dimethoxide, tetraborate compounds, such as tetramethyl ammonium tetraphenyl borohydride, a titanium or zirconium alkoxides, metal diacetates, organotin compounds or borohydride based compounds. The diphenylcarbonate is, in embodiments, used in molar excess with respect to the total number of moles of bisphenol employed; this excess being in the range of from about 5 percent to about 30 percent and preferentially about 10 percent. The catalyst is employed in an effective amount of, for example, from about 0.01 percent to about 1.0 percent molar relative to the bisphenol content, and preferentially in an amount of from about 0.1 to about 0.3 based on the bisphenol. This mixture is heated with stirring in a one liter steel reactor capable of maintaining a vacuum of at least as low as 1.0 mbar. The reactor should also be capable of heating to a temperature at least as high as 300° C. and be equipped with a condenser for the collection of the byproducts, such as phenol, of the polymerization and the molar excess of diphenylcarbonate.

Specifically, the process of the present invention in embodiments can be accomplished as follows: there can be added to a one liter reactor 4,4'-(1,4-phenylenebisisopropylidene) bisphenol, about 173 grams, or approximately half of a mole, and 4,4'-hexafluoroisopropylidene bisphenol, about 168 grams, or approximately half of a mole, together with a molar excess of diphenyl carbonate of about 10 percent or 235.6 grams. A catalyst, such as titanium butoxide, can be added in the amount of about 0.5 milliliter of the solid bisphenols and diphenylcarbonate melt with heating. Heating can be accomplished by an electric element heater that surrounds the reactor vessel. The monomer mixture comprised of the bisphenols and diphenylcarbonate melts in the temperature range of about 80° C. to about 140° C. Upon melting, the reactor is sealed, stirring initiated, and a continuous stream of dry nitrogen gas is flushed through the reactor for 50 minutes or other effective time. The reactor temperature is raised to about 220° C. over a period of about 50 minutes. This temperature is maintained while the pressure in the reactor is lowered by means of a mechanical vacuum pump. The pressure is lowered from about 1,000 mbar to about 500 mbar over a period of about 10 minutes. The pressure is then further reduced to about 0 mbar over a period of about 80 minutes. After the temperature has been maintained at 220° C. for about 100 to about 180 minutes, but preferentially about 133 minutes, the progress of the reaction may be monitored by the rise in the stirrer torque, the stirrer torque increases being indicated by the millivolt signal of a HBM torque transducer and meter which rises from about 0.012 mV to between about 0.1 and 0.3 millivolt as the melt viscosity increases from about 10 centipoise to about 1,000,000 or more centipoise and the rise in the viscosity is caused by the increase in the polymer molecular weight as the reaction progresses or by the collection of the phenol byproduct, since 2 moles of phenol are produced by every mole of bisphenol that polymerizes, the extent of the polymerization can be directly followed. The temperature is then increased to about 280° C. in about 10 minutes. This temperature is maintained for about 97 minutes. The temperature is then increased to about 300° C. in about 10 minutes. This temperature is maintained for about 97 minutes. The reactor is then repressurized with dry nitrogen gas to atmospheric pressure and the resulting molten polymer is drawn with large forceps from the reactor bottom into a dry inert atmosphere and cut with wire cutters where it is permitted to cool to room temperature, about 25° C., to provide the product, poly(4,4'-hexafluoroisopropylidene bisphenol-co-4,4'-(1,4-phenylenebisisopropylidene) bisphenol) carbonate (0.5:0.5M). The products and structures were confirmed by NMR and $M_n$=20,800 and $M_w$=57,500 for the specific aforementioned product. Subsequent to effecting purification of the product, it can be treated by the process outlined in U.S. Pat. No. 4,921,940, the disclosure of which is totally incorporated herein by reference, whereby, for example, 10 grams of the polycarbonate product was added to 100 milliliters of dimethylformamide as the polymer solvent containing 0.25 gram of tartaric acid as the complexing component. Following stirring of the mixture for 16 hours, the resulting polymer solution was precipitated into 3 liters of rapidly stirring deionized water. The polymer was recovered by filtration and dried overnight in a vacuum oven at about 80° C. The presence of the fluorinated monomer can be confirmed by NMR to be a statistical distributed incorporation of the two comonomers. The number average molecular weight, the weight average molecular weight and the $M_w/M_n$ ratio may be determined by a Waters Gel Permeation Chromatograph employing four ULTRASTYRAGEL ® columns with pore sizes of 100, 500, 500, and 104 Angstroms and using THF (tetrahydrofuran) as a solvent.

The fluorinated resin binder is present in the charge transport layer in various effective amounts, such as for example from about 25 to about 75 weight percent and preferably from about 45 to about 65 weight percent. Examples of aryl amine hole transport molecules that may be selected for the photoconductive imaging members of the present invention are illustrated in U.S. Pat. No. 4,265,990, the disclosure of which is totally incorporated herein by reference. Also, examples of charge transport molecules are illustrated in U.S. Pat. No. 4,921,773 and the patents mentioned therein, the disclosures of each of the aforementioned patents, including the '773 patent, being totally incorporated herein by reference. These components are present in various effective amounts such as for example from about 75 to about 25 weight percent and preferably from about 55 to about 35 weight percent.

The charge transport layer can be comprised of various components providing, for example, that they effectively transport charges, especially holes such as an aryl amine compound, or other components, reference the '773 patent mentioned herein, the disclosure of which is totally incorporated herein by reference, and U.S. Pat. No. 4,933,245, the disclosure of which is totally incorporated herein by reference. In one embodiment, the charge transport layers are comprised of aryl amine compounds of the formula:

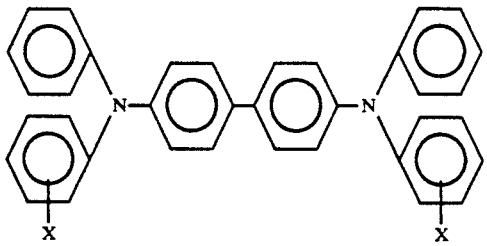

wherein X is selected from the group consisting of alkyl and halogen. Preferably, X is selected from the group consisting of methyl and chloride in either the ortho, meta, or para positions. Compounds corresponding to the above formula include N,N'-diphenyl-N,N'-bis(alkylphenyl)-[1,1'-biphenyl]-4,4'-diamine, wherein alkyl is selected from the group consisting of methyl, such as 2-methyl, 3-methyl and 4-methyl, ethyl, propyl, butyl, hexyl, and the like. With halo substitution, the amine is N,N'-diphenyl-N,N'-bis(halo phenyl)-[1,1'-biphenyl]-4,4'-diamine, wherein halo is 2-chloro, 3-chloro or 4-chloro. Generally, the charge transport layer has a thickness of from about 5 to about 75 microns, and preferably of from about 10 to about 40 microns.

In one specific illustrative embodiment, the photoresponsive imaging device of the present invention can be comprised of (1) a supporting substrate, (2) a hole blocking layer, (3) an optional adhesive interface layer, (4) a photogenerating layer, and (5) a charge transport layer with charge transport components dispersed in a fluorinated polycarbonate. Thus, a specific photoconductive imaging member of the present invention can be comprised of a conductive supporting substrate, a hole blocking metal oxide layer in contact therewith, an adhesive layer, a photogenerating layer comprised, for example, of bisazo compounds, overcoated on the optional adhesive layer, and as a top layer a hole transport layer comprised of certain diamines dispersed in a fluorinated polycarbonate resinous matrix. The photoconductive layer composition when in contact with the hole transport layer is capable of allowing holes generated by the photogenerating layer to be transported.

The photoresponsive devices described herein can be incorporated into various imaging systems such as those conventionally known as xerographic imaging processes. Additionally, the imaging members of the present invention can be selected for imaging and printing systems with visible light and/or near infrared light. In this embodiment, the photoresponsive devices may be negatively charged, exposed to light in a wavelength of from about 400 to about 800, and preferably 400 to 680 nanometers, either sequentially or simultaneously, followed by developing the resulting image and transferring to paper.

BRIEF DESCRIPTION OF THE FIGURES

For a better understanding of the features of the present invention, the following detailed description of various embodiments is provided wherein.

DESCRIPTION OF SPECIFIC EMBODIMENTS

Specific embodiments of the invention will now be illustrated, it being noted that substantially equivalent imaging members are also embraced within the scope of the present invention.

Figure 1:
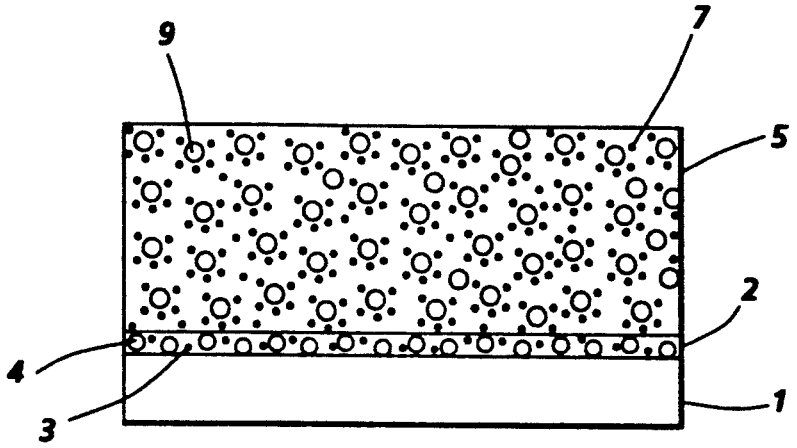
FIGS. 1 and 2 represent partially schematic views of examples of photoconductive imaging members of the present invention.

FIG. 1 illustrates a photoconductive imaging member of the present invention comprising a supporting substrate 1, a photogenerating layer 2 comprised of photogenerating pigments 3 like vanadyl phthalocyanine, trigonal selenium, or titanyl phthalocyanine, especially Type IV titanyl phthalocyanine, dispersed in a resinous binder composition 4, and a charge carrier hole transport layer 5, which comprises hole transporting molecules 7 dispersed in an inactive resinous fluorinated polycarbonate binder composition 9.

Figure 2:
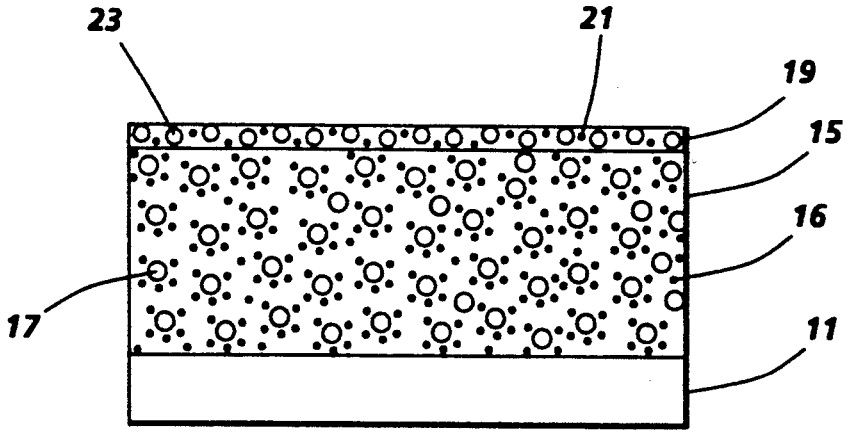

FIG. 2 illustrates essentially the same member as that shown in FIG. 1 with the exception that the hole transport layer is situated between the supporting substrate and the photogenerating layer. More specifically, this Figure illustrates a photoconductive imaging member comprising a supporting substrate 11, a hole transport layer 15 comprising aryl amine hole transport molecules 16 dispersed in the resinous fluorinated polycarbonate of Example I, binder composition 17, and a photogenerating layer 19 comprising photogenerating pigments 21 optionally dispersed in a resinous binder composition 23.

The supporting substrate of the imaging members may comprise an insulating material such as an inorganic or organic polymeric material, including MYLAR®, a commercially available polymer titanized MYLAR®; a layer of an organic or inorganic material having a semiconductive surface layer such as indium tin oxide or aluminum arranged thereon; or a conductive material such as aluminum, titanium, chromium, nickel, brass, or the like. The substrate may be flexible, seamless, or rigid and may have a number of different configurations, such as a plate, a cylindrical drum, a scroll, an endless flexible belt, and the like. In one embodiment, the substrate is in the form of an endless flexible belt. In some situations, it may be desirable to coat an anticurl layer, such as polycarbonate materials commercially available as MAKROLON®, on the back of the substrate, particularly when the substrate is an organic polymeric material.

The thickness of the substrate layer depends on a number of factors, including economic considerations, the components of the other layers, and the like. Thus, this layer may be of substantial thickness, for example up to 135 mils, or of minimal thickness provided that there are no adverse effects on the system. In embodiments, the thickness of this layer is from about 3 mils to about 25 mils.

Generally, the photogenerating layer has a thickness of from about 0.05 micron to about 10 microns or more, and preferably has a thickness of from about 0.1 micron to about 4 microns. The thickness of this layer, however, is dependent primarily upon the photogenerating weight loading, which may vary from about 5 to 100 percent, the components of the other layers, and the like. Generally, it is desirable to provide this layer in a thickness sufficient to absorb a substantial amount, for example from about 80 to about 95 percent or more, of the incident radiation which is directed upon it in the imagewise or printing exposure step. The maximum thickness of this layer is dependent primarily upon factors such as the amount of exposure light used, the thicknesses of the other layers, and whether a flexible photoconductive imaging member is desired. Optionally, resin binders for the photogeneration layer include polyester, polyvinylbutyral, and the like.

The photoconductive imaging member may optionally contain a hole blocking layer situated between the supporting substrate and the photogenerating layer. This layer may comprise metal oxides, such as aluminum oxide and the like, or materials such as silanes, nylons, and the like. The primary purpose of this layer is to prevent hole injection from the substrate during and after charging. Typically, this layer is of a thickness of about 5 to about 300 Angstroms, although it may be as thick as 3 microns in some instances.

In addition, the photoconductive imaging member may also optionally contain an adhesive interface layer situated between the hole blocking layer and the photogenerating layer. This layer may comprise a polymeric material such as polyester, like Polyester-100, polyvinyl butyral, polyvinyl pyrrolidone, and the like. Typically, this layer is, for example, of a thickness of less than about 0.9 micron with a thickness range of from about 0.05 to about 1 micron being suitable in embodiments of the present invention.

In an embodiment, the photoconductive imaging member of the present invention is comprised of (1) a conductive supporting substrate of MYLAR ® with a thickness of 75 microns and a conductive vacuum deposited layer of titanium with a thickness of 0.02 micron; (2) a hole blocking layer of N-methyl-3-aminopropyltrimethoxysilane with a thickness of 0.1 micron; (3) an adhesive layer of 49,000 Polyester (obtained from E.I. DuPont Chemical) with a thickness of 0.05 micron; (4) a photogeneration layer of a dispersion of trigonal selenium with a thickness of 1 micron; and (5) a charge transport layer with a thickness of 20 microns of an aryl amine dispersed in a resin binder of fluorinated polycarbonate of Example I.

Imaging members of the present invention exhibit excellent xerographic properties in embodiments thereof. For example, values for dark development potential ($V_{ddp}$) can range from about −400 to about −975 Volts. Preferred ranges for dark development potential for the imaging members of the present invention are usually about −400 to −900 volts with −800 volts being especially preferred in embodiments. High dark development potentials permit high contrast potentials, which result in images of high quality with essentially no background development.

The imaging members of the present invention in embodiments thereof also exhibit low dark decay values of, for example, about −50 volts per second or less. Low dark decay values can be of importance for developing high quality images since dark decay measures the amount of charge that disappears after charging of the photoreceptor, and a large difference in charge between exposed and unexposed areas of the photoreceptor results in images with high contrast. Acceptable values for dark decay vary depending on the design of the imaging apparatus in which the imaging members are contained. This dark decay may be as high as −100 volts per second with −50 volts and −10 to −20 volts per second being preferred in embodiments.

Residual potential values ($V_R$) for the imaging members of the present invention in embodiments thereof are excellent, ranging from, for example, about −5 volts to about −50 volts. Residual potential is a measure of the amount of charge remaining on the imaging member after erasure by exposure to light and prior to imaging. Residual potentials of −5 to −20 are considered very exceptional.

Photosensitivity values for the imaging members of the present invention in embodiments thereof are acceptable and in some instances excellent, and can be, for example, from about 4 to about 25 ergs per square centimeter. Acceptable photosensitivity values vary depending on the design of the imaging apparatus in which the imaging members are contained; thus in some instances, values as high as 40 or 50 are acceptable, and values of about 5 can be preferred.

The present invention also encompasses a method of generating images with the photoconductive imaging members disclosed herein. The method comprises the steps of generating an electrostatic image on a photoconductive imaging member of the present invention, subsequently developing the electrostatic image with known developer compositions comprised of resin particles, pigment particles, additives, including charge control agents and carrier particles, reference U.S. Pat. Nos. 4,558,108; 4,560,535; 3,590,000; 4,264,672; 3,900,588 and 3,849,182, the disclosures of each of these patents being totally incorporated herein by reference, transferring the developed electrostatic image to a suitable substrate, and permanently affixing the transferred image to the substrate. Development of the image may be achieved by a number of methods, such as cascade, touchdown, powder cloud, magnetic brush, and the like. Transfer of the developed image to a substrate may be by any method, including those wherein a corotron or a biased roll is selected. The fixing step may be performed by means of any suitable method, such as flash fusing, heat fusing, pressure fusing, vapor fusing, and the like.

The imaging members of the present invention can be prepared by a number of different known processes such as those illustrated in U.S. Ser. No. 07/617,234, the disclosure of which is totally incorporated herein by reference. In one process embodiment, the vanadyl phthalocyanine photogenerator is coated onto a supporting substrate with a Bird applicator, for example, followed by the solution coating of the charge transport layer, and thereafter drying in, for example, an oven.

The following Examples are being supplied to further define various species of the present invention, it being noted that these Examples are intended to illustrate and not limit the scope of the present invention. Parts and percentages are by weight unless otherwise indicated. Comparative data is also presented.

EXAMPLE I

Polymerization

The reactor employed was a 1 liter stainless steel reactor equipped with a helical coil stirrer and a double mechanical seal. It was driven by a 0.5 horsepower motor with a 30:1 gear reduction. A torque meter was part of the stirrer drive. The reactor was heated electrically. The pressure was monitored by both pressure transducer and pirani gauge. The temperature was monitored by platinum RTDs. The pressure and temperature were precisely controlled and profiled by a Fischer and Porter Chameleon controller. A specially designed condenser ensured the monitoring of the efficient condensation of phenol and diphenylcarbonate. A proportioning valve and a rotary oil pump provided controlled variations in reactor pressure.

To this reactor was added bisphenol P (4,4'-(1,4-phenylenebisisopropylidene)bisphenol), 173.1 grams, 0.5 moles; bisphenol AF (4,4'-hexafluoroisopropylidene bisphenol), 168.1 grams, 0.5 moles; diphenylcarbonate, 235.6 grams, 1.1 moles; and titanium butoxide, 0.5 milliliter.

The reactor was sealed and the temperature raised to about 220° C. The pressure was then lowered to about 500 millibars in the space of about 10 minutes. Phenol began to collect in the condenser as the pressure neared 500 millibars. The rate of pressure decrease was slowed so that about 80 minutes was required to reach a pressure below 2 millibars. After a total of 170 minutes at 220° C., the temperature was raised to 260° C. and held there for about 67 minutes. The temperature was then raised to and retained at 280° C. for about 97 minutes and then to 300° C. for a further 120 minutes. The molten polymer was then drawn out of the reactor into a dry nitrogen atmosphere to cool.

The obtained polymer poly(4,4'-hexafluoroisopropylidene bisphenol-co-4,4'-(1,4-phenylenebisisopropylidene) bisphenol) carbonate (0.5:0.5) had a $T_g$ of 155° C. as determined on a DuPont Instruments DSC 10. The GPC molecular weight averages were determined on a Waters chromatography system using a 100 Å, two 500 Å and a 104 Å Waters ULTRASTRYRAGEL® columns calibrated with narrow molecular weight polystryrene standards and found to be $M_n$=20,800 and $M_w$=57,500. NMR confirms the structure. Ten grams of the polymer were added to 100 milliliters of DMF containing 0.25 gram of tartaric acid and stirred overnight, about 18 hours. The polymer solution was precipitated into 1.5 liters of rapidly stirred deionized water. The polymer in quantitative yield was subsequently dried and evaluated as a charge transport matrix polymer in a photoreceptor.

EXAMPLE II

The process of Example I was repeated with the following changes in the temperature profile: total time at 220° C. was lowered to 133 minutes, the temperature plateau at 260° C. was eliminated, the time at 280° C. remained at 97 minutes, and the time at 300° C. was reduced to 97 minutes. The polymer produced had a $T_g$ of 161° C. and GPC molecular weight averages of $M_n$=29,300 and $M_w$=87,800.

EXAMPLE III

The process of Example II was repeated with the following reactants bisphenol AP (4,4'-(1-phenylethylidene) bisphenol), 143.5 grams, 0.5 moles; bisphenol AF (4,4'-hexafluoroisopropylidene bisphenol), 168.1 grams, 0.5 moles; and diphenylcarbonate, 235.6 grams, 1.1 moles; and titanium butoxide, 0.5 milliliter.

The polymer product poly(4,4'-hexafluoroisopropylidene bisphenol-co-4,4'-(1-phenylethylidene) bisphenol) carbonate (0.5:0.5M) had a $T_g$ of 178° C. and GPC molecular weight averages of $M_n$=27.600 and $M_w$=70,900.

EXAMPLE IV

The process of Example II was repeated with the following reagents bisphenol Z (4,4'-cyclohexylidene bisphenol), 134.0 grams, 0.5 moles; bisphenol AF (4,4'-hexafluoroisopropylidene bisphenol), 168.1 grams, 0.5 moles; diphenylcarbonate, 235.6 grams, 1.1 moles; and titanium butoxide, 0.5 milliliter.

The polymer product poly(4,4'-hexafluoroisopropylidene bisphenol-co-4,4'-cyclohexylidene bisphenol) carbonate (0.5:0.5M) had a $T_g$ of 170° C. and GPC molecular weight averages of $M_n$=27.700 and $M_w$=120,000.

EXAMPLE V

The process of Example II was repeated with the following reactants bisphenol Z (4,4'-cyclohexylidene bisphenol), 67.0 grams, 0.25 moles; bisphenol AF (4,4'-hexafluoroisopropylidene bisphenol), 252.2 grams, 0.75 moles; diphenylcarbonate, 235.6 grams, 1.1 moles; and titanium butoxide, 0.5 milliliter.

The polymer poly(4,4'-hexafluoroisopropylidene bisphenol-co-4,4'-cyclohexylidene bisphenol) carbonate (0.75:0.25M) had a $T_g$ of 173° C. and GPC molecular weight averages of $M_n$=27,800 and $M_w$=56,700.

EXAMPLE VI

The process of Example II was repeated with the following reagents bisphenol Z (4,4'-cyclohexylidene bisphenol), 201.0 grams, 0.75 moles; bisphenol AF (4,4'-hexafluoroisopropylidene bisphenol), 84.1 grams, 0.25 moles; diphenylcarbonate, 235.6 grams, 1.1 moles; and titanium butoxide, 0.5 milliliter.

The polymer poly(4,4'-hexafluoroisopropylidene bisphenol-co-4,4'-cyclohexylidene bisphenol) carbonate (0.25:0.75M) had a Tg of 175° C. and GPC molecular weight averages of $M_n$=29,200 and $M_w$=75,900.

EXAMPLE VII

The process of Example II was repeated with the following reagents bisphenol AF (4,4'-hexafluoroisopropylidene bisphenol), 180.8 grams, 0.54 moles; diphenylcarbonate, 126.7 grams, 0.59 moles; and titanium butoxide, 0.25 milliliter.

The polymer poly(4,4'-hexafluoroisopropylidene bisphenol) carbonate had a Tg of 170° C. and GPC molecular weight averages of $M_n$=30,900 and $M_w$=68,900.

EXAMPLE VIII

The method of Example II was repeated with the following reagents bisphenol A (4,4'-isopropylidenebisphenol), 114.1 grams, 0.5 moles; bisphenol AF (4,4'-hexafluoroisopropylidene bisphenol), 168.1 grams, 0.5 moles; diphenylcarbonate, 235.6 grams, 1.1 moles; and titanium butoxide, 0.5 milliliter.

The polymer poly(4,4'-hexafluoroisopropylidene bisphenol-co-4,4'-isopropylidene bisphenol) carbonate (0.5:0.5M) had a Tg of 158° C. and GPC molecular weight averages of $M_n$=28,700 and $M_w$=62,200.

EXAMPLE IX

The method of Example II was repeated with the following reagents bisphenol M (4,4'-(1,3-phenylenebisisopropylidene) bisphenol), 173.1 grams, 0.5 moles; bisphenol AF (4,4'-hexafluoroisopropylidene bisphenol), 168.1 grams, 0.5 moles; diphenylcarbonate, 235.6 grams, 1.1 moles; and titanium butoxide, 0.5 milliliter.

The polymer poly(4,4'-hexafluoroisopropylidene bisphenol-co-(4,4'-(1,3-phenylenebisisopropylidene) bisphenol)) carbonate (0.5:0.5M) had a $T_g$ of 121° C. and GPC molecular weight averages of $M_n$=28,200 and $M_w$=59,300.

EXAMPLE X

The process of Example II was repeated except that a 100 milliliter stainless steel reactor was used along with the following reagents bisphenol P (4,4'-(1,4-phenylenebisisopropylidene) bisphenol), 13.0 grams, 0.0375 moles; bisphenol AF (4,4'-hexafluoroisopropylidene bisphenol), 8.4 grams, 0.025 moles; 4,4'-biphenol, 7.0 grams, 0.0375 moles; diphenylcarbonate, 23.6 grams, 0.11 moles; and titanium butoxide, 0.05 milliliter.

The polymer poly(4,4'-hexafluoroisopropylidene bisphenol-co-(4,4'-(1,4-phenylenebisisopropylidene) bisphenol)-co-4,4'-biphenol) carbonate (0.25:0.375:0.375M) had a $T_g$ of 147° C. and GPC molecular weight averages of $M_n$=14,400 and $M_w$=32,300.

EXAMPLE XI

A layered photoresponsive imaging member comprised of N,N'-diphenyl-N,N'-bis(3-methylphenyl)-[1,1'-biphenyl]-4,4'-diamine (TPD) molecularly dispersed in the fluorinated polymer binder of Example I as the hole transport layer, and a trigonal selenium generator layer was fabricated as follows:

A dispersion of trigonal selenium and poly(N-vinyl carbazole) was prepared by ball milling 1.6 grams of trigonal selenium and 1.6 grams of poly(N-vinyl carbazole) in 14 milliliters each of tetrahydrofuran and toluene. Ten grams of the resulting slurry were then diluted with a solution of 0.24 gram of N,N'-diphenyl-N,N'-bis(3-methylphenyl)-[1,1'-biphenyl]-4,4'-diamine (TPD) in 5 milliliters each of tetrahydrofuran and toluene. A 1.5 micron thick photogenerator layer was fabricated by coating the above dispersion onto an aluminized MYLAR ® substrate, thickness of 75 microns, with a Bird film applicator, followed by drying in a forced air oven at 135° C. for 5 minutes. A solution for the charge transport layer was then prepared by dissolving 0.8 gram of N,N'-diphenyl-N,N'-bis(3-methylphenyl)-[1,1'-biphenyl]-4,4'-diamine (TPD), and 1.2 grams of the polymer binder of Example I in 10 milliliters of methylene chloride. This solution was then coated over the photogenerator layer by means of a Bird film applicator. The resulting member was then dried in a forced air oven at 135° C. for 20 minutes, resulting in a 20 micron thick charge transport layer.

A solution for a charge transport layer of a control imaging member was then prepared by dissolving 0.8 gram of N,N'-diphenyl-N,N'-bis(3-methylphenyl)-[1,1'-biphenyl]-4,4'-diamine (TPD), 1.2 grams of bisphenol A polycarbonate (MAKROLON 5705 ®) in 10 milliliters of methylene chloride. This solution was then coated over the above photogenerator layer by means of a Bird film applicator. The resulting layered photoconductive imaging member was then dried in a forced air oven at 135° C. for 20 minutes, resulting in a 20 micron thick charge transport layer.

A wear test fixture was set up to measure the relative wear and wear rates of charge transport layers subjected to toner interactions and blade cleaning. The two photoresponsive imaging members fabricated as described above were used by wrapping around and taping onto an aluminum drum in the test fixture. The drum speed controlled by a motor can be varied and is usually maintained at about 55 rpm during the test. Toner is supplied continuously from a hopper and cleaning of the residual toner on the imaging member was achieved by a cleaning blade. The typical test conditions during a wear test are described as follows:

Toner: 46.7 percent of polystyrene/n-butylacrylate copolymer (58/42), 49.6 percent of cubic magnetite BL220, 1.0 percent of P51, an aluminum salt, charge control additive obtained from Hodogaya Chemical of Japan, 2.5 percent of 660P Wax (polypropylene obtained from Sanyo of Japan) and 0.2 percent of AEROSIL R972 ®.

Blade: Xerox imaging device 1065 cleaning blade

Drum speed: 55 rpm

Number of cycles: 50,000

A new cleaning blade was used in each test. The blade force was about 30 grams/centimeter and was adjusted by a micrometer mounted on the blade holder. The wear was determined as the loss in thickness of the charge transport layer and was the difference in thickness of the charge transport layer before and after the wear test. The wear was expressed in nanometers. The wear rate was obtained by dividing the wear by the number of cycles and is expressed as nanometers/K cycle. The wear rate was normalized and was independent of any variations in the total number of cycles of the wear tests. The data obtained was shown in Table 1 wherein the reduced wear of the polymer of Example I with respect to the control was shown. The wear test results shown on Table 1 indicates that a polymer binder of Example I, when used in the charge transport layer of the photoreceptor device, exhibited a wear rate of about 12 nanometers/K cycle which was half the wear rate obtained with bisphenol A polycarbonate (MAKROLON 5705 ®) (control photoreceptor) tested under similar conditions.

TABLE 1

Effect of Polymer Binder on the Wear of CTL (Charge Transport Layer)

| Polymer Binder Sample # | Wear in 50,000 Cycles μm | Wear Rate nm/K Cycle |
|---|---|---|
| MAKROLON 5705 ® Control | 1.2 | 24 |
| Example I Polymer | 0.6 | 12 |
| Example III Polymer | 1.5 | 30 |

EXAMPLE XII

The layered photoresponsive imaging members of Example XI were tested electrically as follows:

The xerographic electrical properties of the aforementioned imaging members of Example XI were determined by electrostatically charging the surfaces thereof with a corona discharge source until the surface potentials, as measured by a capacitively coupled probe attached to an electrometer, attained an initial value $V_o$ of about −800 volts. After resting for 0.5 second in the dark, the charged members reached a surface potential of $V_{ddp}$, dark development potential, and each member was then exposed to light from a filtered Xenon lamp with a XBO 150 watt bulb. A reduction in surface potential to a $V_{bq}$ value, background potential, due to photodischarge effect was observed. The background potential was reduced by exposing with a light intensity about 10 times greater than the expose energy. The resulting potential on the imaging member was designated as the residual potential, Vr. The dark decay in volt/second was calculated as $(V_o-V_{ddp})/0.5$. The percent of photodischarge was calculated as 100 percent $(V_{ddp}-V_{bg})/V_{ddp}$. The desired wavelength and energy of the expose light was determined by the type of filters placed in front of the lamp. The broad band white light (400 to 700 nanometers) photosensitivity of these imaging members were measured by using an infrared cut-off filter whereas the monochromatic light photosensitivity was determined using narrow band-pass filter. The photosensitivity of the imaging members is usually provided in terms of the amount of expose energy in erg/cm$^2$, designated as $E_{\frac{1}{2}}$, required to achieve 50 percent of photodischarge from the dark development potential. The higher the photosensitivity, the smaller is the $E_{\frac{1}{2}}$ value. The devices were subjected to 1,000 cycles of repeated charging, discharging and erase to determine the cycling stability. Changes in $V_{ddp}$, $V_{bg}$, $V_{res}$ are indicated as $\Delta V_{ddp}$, $\Delta V_{bg}$, $\Delta V_{res}$.

A summary of the results of the electrical testing of the imaging members of Example XI is shown on Table 2. For the imaging member based on the fluorinated polycarbonate of Example I as the binder, the acceptance potential was −800 volts, the residual potential was −20 volts and the photosensitivity ($E_{\frac{1}{2}}$) was 2.3 ergs/cm$^2$. The results obtained with the control imaging member based on bisphenol A polycarbonate (MAKROLON 5705®) as the polymer binder and shown on Table 2 indicate that the acceptance potential was −800 volts, the residual potential was −22 volts and the photosensitivity was 2.1 ergs/cm$^2$. The imaging members were subjected to 1,000 cycles of repeated charging, discharging and erase and exhibit excellent cycling stability as shown on Table 2.

The results indicate excellent cycling stability with the polymer binder of Example I. This demonstrates the potential of this class of polymer binders to be used as lower wear resistant binders in the charge transport layer for photoresponsive imaging members.

TABLE 2

Xerographic Cycling Stability - Fluorinated Polycarbonate

| Xerographic Parameters | Control Device MAKROLON 5705 ® as Binder | Fluorinated Polycarbonate of Example I as Binder |
|---|---|---|
| Vddp (V) | −800 | −800 |
| $E_{\frac{1}{2}}$(ergs/cm$^2$) | 2.1 | 2.3 |
| $V_{residual}$(V) | 22 | 20 |
| Cycling data | | |
| No. of cycles | 1,000 | 1,000 |
| $\Delta V_{ddp}$(V) | −36 | −40 |
| $\Delta V_{bkg}$(V) | 5 | 0 |
| $\Delta V_{residual}$(V) | 10 | 10 |

EXAMPLE XIII

A photoresponsive imaging member comprised of a polymer binder of Example I as the resinous binder in the charge transport layer and vanadyl phthalocyanine as the photogenerator was prepared as follows:

A titanized MYLAR® substrate with a thickness of about 75 microns comprised of MYLAR® with a thickness of 75 microns and titanium film with a thickness of 0.02 micron was obtained from Martin Processing Inc. The titanium film was coated with a solution of 1 milliliter of 3-aminopropyltrimethoxysilane in 100 milliliters of ethanol. The coating was heated at 110° C. for 10 minutes resulting in the formation of a 0.1 micron thick polysilane layer. The polysilane layer is a hole blocking layer and prevents the injection of holes from the titanium film and blocks the flow of holes into the charge generation layer. The polysilane layer is used to obtain the desired initial surface charge potential of about −800 volts for this imaging member. A dispersion of a photogenerator prepared by ball milling a mixture of 0.07 gram of vanadyl phthalocyanine and 0.13 gram of Vitel PE-200 polyester (Goodyear) in 12 milliliters of methylene chloride for 24 hours was coated by means of a Bird film applicator on top of the polysilane layer. After drying the coating in a forced air oven at 135° C. for 10 minutes, a 0.5 micron thick vanadyl phthalocyanine photogenerating layer with 35 percent by weight of vanadyl phthalocyanine and 65 percent by weight of polyester was obtained. A solution for the charge transport layer was then prepared by dissolving 0.8 gram of N,N'-diphenyl-N,N'-bis(3-methylphenyl)-[1,1'-biphenyl]-4,4'-diamine (TPD), 1.2 grams of fluorinated polycarbonate of Example I in 10 milliliters of methylene chloride. This solution was then coated over the photogenerator layer by means of a Bird film applicator. The resulting layered photoconductive imaging member was then dried in a forced air oven at 135° C. for 20 minutes resulting in a 20 micron thick charge transport layer.

The above fabricated imaging member was tested electrically in accordance with the procedure of Example XII. Specifically, this imaging member was negatively charged to 800 volts and discharged when exposed to monochromatic light of a wavelength of 830 nanometers. The half decay exposure sensitivity for this device was 8 ergs/cm$^2$ and the residual potential was 15 volts. The electrical properties of this imaging member remained essentially unchanged after 1,000 cycles of repeated charging and discharging.

Other modifications of the present invention will occur to those skilled in the art subsequent to a review of the present application. These modifications and equivalents thereof are intended to be included within the scope of this invention.

What is claimed is:

1. An abrasion resistant photoconductive imaging member comprised of a supporting substrate, a photogenerating layer and a charge transport layer comprised of charge transport components dispersed in a fluorinated polycarbonate selected from the group consisting of poly(4,4'-hexafluoroisopropylidene bisphenol-co-4,4'-(1,4-phenylenebisisopropylidene) bisphenol) carbonate, poly(4,4'-hexafluoropropylidene bisphenol-co-4,4'-(1,4-phenylenebispropylidene) bisphenol) carbonate, poly(4,4'-hexafluoroalkylidene bisphenol-co-4,4'-(1,4-phenylenebisalkylidene) bisphenol) carbonate, poly(4,4'-hexafluoroisopropylidene bisphenol) carbonate, poly(4,4'-hexafluoroisopropylidene bisphenol-co-4,4'-isopropylidene bisphenol) carbonate, poly(4,4'-hexafluoroisopropylidene bisphenol-co-4,4'-(1.3-phenylenebisisopropylidene) bisphenol) carbonate, poly(4,4'-hexafluoroisopropylidene bisphenol-co-4,4'-isopropylidene-2,2'-dimethyl bisphenol) carbonate, poly(4,4'-hexafluoroisopropylidene bisphenol-co-(4,4'-(1,4-phenylenebisisopropylidene) bisphenol)-co-4,4'-bisphenol) carbonate, poly(4,4'-hexafluoroisopropylidene bisphenol-co-4,4'-diphenylmethylidene bisphenol) carbonate, poly(4,4'-hexafluoroisopropylidene bisphenol-co-4,4'-cycloheptylidene bisphenol) carbonate, poly(4,4'-hexafluoroisopropylidene bisphenol-co-4-t-butylcyclohexylidene bisphenol) carbonate, and poly(4,4'-hexafluoroisopropylidene bisphenol-co-(4,4'-(1,4-phenylenebisisopropylidene) bisphenol)-co-4,4'-dihydroxydiphenylether)carbonate; and wherein said charge transport components are comprised of aryl amine molecules of the formula

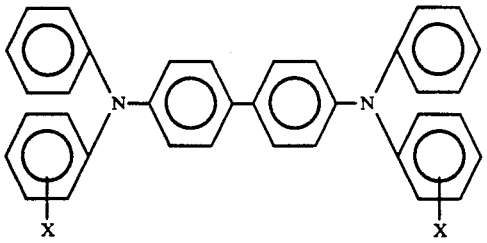

wherein X is selected from the group consisting of hydrogen, alkyl and halogen.

2. A photoconductive imaging member in accordance with claim 1 wherein the photogenerating layer is situated between the supporting substrate and the charge transport layer.

3. A photoconductive imaging member in accordance with claim 1 wherein the charge transport layer is situated between the supporting substrate and the photogenerating layer.

4. A photoconductive imaging member in accordance with claim 1 wherein the photoconductive imaging member includes a metal oxide hole blocking layer situated between the supporting substrate and the photogenerating layer.

5. A photoconductive imaging member in accordance with claim 4 wherein the metal oxide is aluminum oxide.

6. A photoconductive imaging member in accordance with claim 5 wherein the metal oxide hole-blocking layer has a thickness of less than about 500 Angstroms.

7. A photoconductive imaging member in accordance with claim 4 wherein the photoconductive imaging member contains an adhesive interface layer situated between the supporting substrate and the metal oxide hole blocking layer.

8. A photoconductive imaging member in accordance with claim 7 wherein the adhesive interface layer comprises a polymeric material selected from the group consisting of polyester, polyvinylbutyral, and polyvinyl pyrrolidone.

9. A photoconductive imaging member in accordance with claim 7 wherein the adhesive interface layer has a thickness of less than about 0.6 micron.

10. A photoconductive imaging member in accordance with claim 1 wherein the supporting substrate is a metal, or an organic polymeric composition.

11. A photoconductive imaging member in accordance with claim 10 wherein the metal is aluminum or titanium.

12. A photoconductive imaging member in accordance with claim 1 wherein the supporting substrate has a thickness of from about 3 to about 100 mils, and wherein the photogenerating layer has a thickness of from about 0.05 to about 10 microns.

13. A photoconductive imaging member in accordance with claim 1 wherein the photogenerating layer has a thickness of from about 0.1 to about 3 microns.

14. A photoconductive imaging member in accordance with claim 1 wherein the charge transport layer has a thickness of from about 5 to about 50 microns.

15. A photoconductive imaging member in accordance with claim 1 wherein the photogenerating layer is comprised of photogenerating pigments dispersed in a resinous binder in an amount of from about 5 percent by weight to about 95 percent by weight.

16. A photoconductive imaging member in accordance with claim 15 wherein the photogenerating pigment is selected from the group consisting of selenium, metal free phthalocyanines, metal phthalocyanines, vanadyl phthalocyanines, and titanyl phthalocyanines.

17. A method of imaging which comprises the steps of:

(a) generating an electrostatic image on the photoconductive imaging member of claim 1;
(b) subsequently developing the electrostatic image;
(c) transferring the developed electrostatic image to a suitable substrate; and
(d) permanently affixing the transferred image to the substrate.

18. An abrasion resistant photoconductive imaging member consisting essentially of a supporting substrate, a photogenerating layer and a charge transport layer comprised of charge transport components dispersed in a fluorinated polycarbonate and wherein said fluorinated polycarbonate selected from the group consisting of poly(4,4'-hexafluoroisopropylidene bisphenol-co-4,4'-(1,4-phenylenebisisopropylidene) bisphenol) carbonate, poly(4,4'-hexafluoropropylidene bisphenol-co-4,4'-(1,4-phenylenebispropylidene) bisphenol) carbonate, poly(4,4'-hexafluoroalkylidene bisphenol-co-4,4'-(1,4-phenylenebisalkylidene) bisphenol) carbonate, poly(4,4'-hexafluoroisopropylidene bisphenol) carbonate, poly(4,4'-hexafluoroisopropylidene bisphenol-co-4,4'-isopropylidene bisphenol) carbonate, poly(4,4'-hexafluoroisopropylidene bisphenol-co-4,4'-(1,3-phenylenebisisopropylidene) bisphenol) carbonate, poly(4,4'-hexafluoroisopropylidene bisphenol-co-4,4'-isopropylidene-2,2'-dimethyl bisphenol) carbonate, poly(4,4'-hexafluoroisopropylidene bisphenol-co-(4,4'-(1,4-phenylenebisiopropylidene) bisphenol)-co-4,4'-bisphenol) carbonate, poly(4,4'-hexafluoroisopropylidenebisphenol-co-4,4'-diphenylmethylidene bisphenol) carbonate, poly(4,4'-hexafluoroisopropylidene bisphenol-co-4,4'-cycloheptylidene bisphenol) carbonate, poly(4,4'-hexafluoroisopropylidene bisphenol-co-4-t-butylcyclohexylidene bisphenol) carbonate, and poly(4,4'-hexafluoroisopropylidene bisphenol-co-(4,4'-(1,4-phenylenebisisopropylidene) bisphenol)-co-4,4'-dihydroxydiphenylether)carbonate 19. A photoconductive imaging member in accordance with claim 18 wherein the charge transport components are comprised of hole transport molecules.

20. An imaging member in accordance with claim 1 wherein the fluorinated polycarbonate is poly(4,4'-hexafluoroisopropylidene bisphenol-co-4,4'-(1,4-phenylenebisisopropylidene) bisphenol) carbonate with an $M_n$ of 20,800 and an $M_w$ of 57,500.

21. An imaging member in accordance with claim 20 wherein said carbonate has an $M_n$ of 29,300 and an $M_w$ of 87,800.

22. An imaging member in accordance with claim 1 wherein said fluorinated polycarbonate is poly(4,4'-hexafluoroisopropylidene bisphenol-co-4,4'-(1-phenylethylidene)bisphenol) carbonate with an $M_n$ of 27,600 and an $M_w$ of 70,900.

23. An imaging member in accordance with claim 1 wherein the photogenerating layer is comprised of a photogenerating pigment of trigonal selenium dispersed in a resinous binder of poly(N-vinyl carbazole) and the charge transport layer is comprised of aryl amine molecules of N,N'-diphenyl-N,N'-bis(3-methylphenyl)-[1,1'-biphenyl]-4,4'-diamine.

* * * * *